United States Patent [19]

Breslow

[11] 3,980,298

[45] Sept. 14, 1976

[54] CONCEALED PLAYING PIECE APPARATUS

[75] Inventor: Jeffrey D. Breslow, Highland Park, Ill.

[73] Assignee: Marvin Glass & Associates, Chicago, Ill.

[22] Filed: Oct. 20, 1975

[21] Appl. No.: 623,755

[52] U.S. Cl. ..... 273/1 R

[51] Int. Cl.[2] ..... A63F 9/00

[58] Field of Search ..... 273/1 R, 130 R, 130 AC, 273/130 D, 134 C, 134 B, 134 AG, 134 AD, 134 AF, 134 AA, 134 AB, 134 AE, 134 R, 135 R, 135 AC

[56] References Cited

UNITED STATES PATENTS

| | | | |
|---|---|---|---|
| 3,378,261 | 4/1968 | Schriber | 273/130 R |
| 3,484,105 | 12/1969 | Winston | 273/1 R |
| 3,582,075 | 6/1971 | Glass | 273/1 R |
| 3,677,548 | 7/1972 | Hincz | 273/130 R |
| 3,710,455 | 1/1973 | Liversidge | 273/130 R |
| 3,841,628 | 10/1974 | Goldfarb | 273/1 R |
| 3,865,379 | 2/1975 | Breslow | 273/134 C |

*Primary Examiner*—Anton O. Oechsle
*Assistant Examiner*—Marvin Siskind
*Attorney, Agent, or Firm*—Coffee & Sweeney

[57] ABSTRACT

A game apparatus which includes a plurality of differently shaped playing pieces. A plurality of receptacles are provided for individually concealing or exposing each of the playing pieces. A plurality of cards are provided, each having indicating means thereon corresponding to one of the playing pieces. A chance device is provided for determining, during a player's turn, whether the player is to obtain a card or whether the player is to attempt to expose a playing piece corresponding to the indicating means on one of the cards that player has obtained.

10 Claims, 4 Drawing Figures

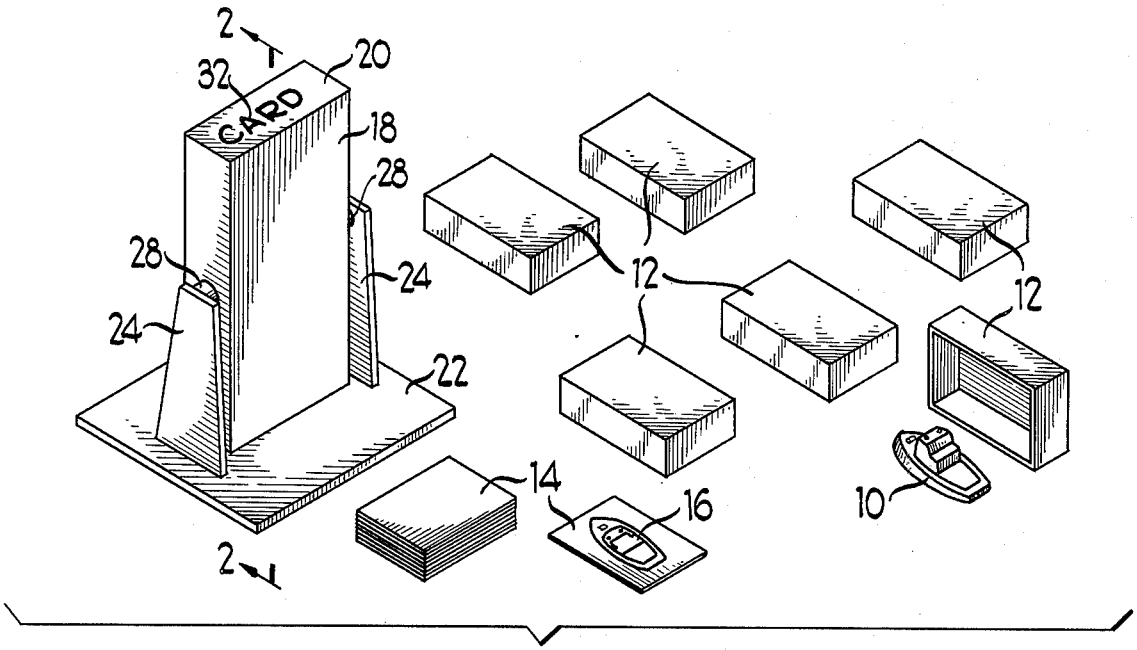
Fig 1
Fig 2
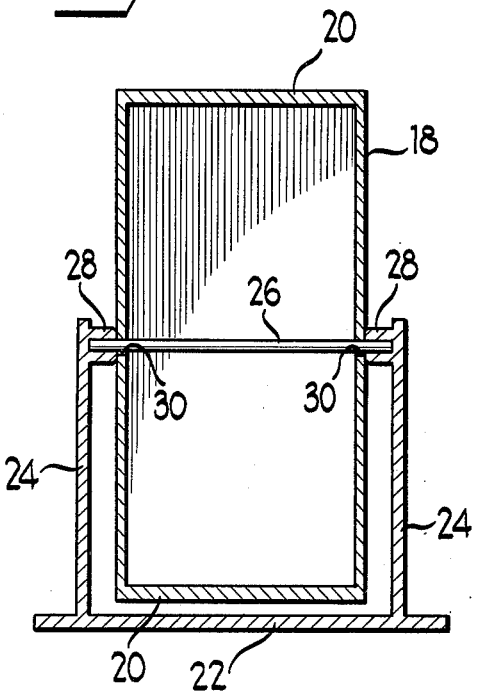
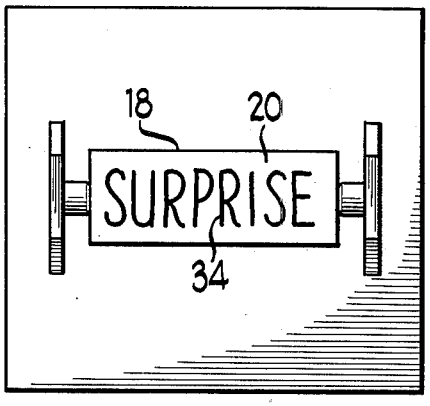
Fig 3
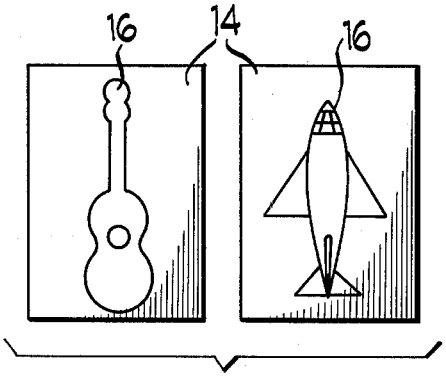
Fig 4

CONCEALED PLAYING PIECE APPARATUS

BACKGROUND AND SUMMARY OF THE INVENTION

This invention relates to game devices and, in particular, to a game apparatus which not only involves the element of chance, but also requires memory on behalf of the individual players.

Many game apparatus which include chance devices are available which involve solely the element of chance whereby the result of the game has nothing to do with a player's skill. The present invention is directed to providing a game apparatus which not only involves the element of chance but also involves the use of memory or recollection on behalf of the players so as to remember the disposition of certain playing pieces.

More particularly, in the exemplary embodiment of the invention, the game apparatus includes a plurality of differently shaped three-dimensional miniature toys, such as a boat, airplane, guitar, etc. A plurality of open bottom box-like members are provided for individually covering and thereby concealing or selectively exposing each of the playing pieces. A plurality of cards are provided each having indicating means thereon in the form of a picture of one of the playing pieces. A chance device is provided for determining, during a player's turn, whether the player is to pick a card or whether the player is to attempt to expose a playing piece corresponding to one of the cards that player has obtained. The chance device is in the form of a rectangular box-like member having opposite end walls with indicating means thereon instructing a player, on one end wall, to pick a card and instructing a player, on the opposite end wall, to expose a playing piece by uncovering the same. The box-like member is mounted on a support structure for rotation about a generally horizontal axis intermediate the end walls so that the end wall which faces upwardly after a "spin" of the box determines the play of the game. With this game apparatus, as players expose certain playing pieces, and fail to match one of their cards, all of the players must remember where that playing piece is located in the event that he obtains a card on a subsequent turn matching the previously uncovered playing piece. If a player successfully matches a playing piece, that playing piece is then acquired by the player.

Other objects, features and advantages of the invention will be apparent from the following detailed description taken in connection with the accompanying drawings.

BRIEF DESCRIPTION OF THE DRAWINGS

FIG. 1 is a perspective view of the game apparatus of the present invention, showing one of the playing pieces uncovered and matching one of the playing cards;

FIG. 2 is a vertical section, on an enlarged scale, through the spinner-type chance device shown in FIG. 1;

FIG. 3 is a top plan view of the chance device with the box-like spinner disposed so as to instruct a player to uncover a playing piece; and FIG. 4 is a plan view of two of the playing cards used with the game apparatus of the present invention.

DETAILED DESCRIPTION OF THE INVENTION

Referring to the drawings in greater detail, a plurality of three-dimensional differently shaped playing pieces 10 (FIG. 1) are provided. The playing pieces are in the form of small toys, such as a boat (as shown in FIG. 1), airplane, guitar, or the like.

A plurality of open bottom rectangular box-like devices 12 (FIG. 1) are provided and of a size so as to cover and conceal the playing pieces and to permit selective exposing of the playing pieces by the players of the game. A plurality of cards 14 (FIGS. 1 and 4) are provided and have indicating means on one side thereof in the form of a picture matching one of the playing pieces 10. For instance, the card which is turned over in FIG. 1 has a picture of a boat matching the toy boat playing piece 10 shown in FIG. 1. Each card has a picture matching one of the playing pieces. FIG. 4 shows two more cards having indicating means 16 thereon in the form of a picture of a guitar (to the left of FIG. 4) and a picture of an airplane (to the right of FIG. 4) which would match corresponding playing pieces.

A chance device is provided for determining, during a player's turn, whether the player is to obtain a card or whether the player is to attempt to expose one of the playing pieces 10 corresponding to the indicating means 16 on one of the cards 14 which that player has obtained. This chance device is in the form of a rectangular box-like member 18 having opposite end walls 20. The box-like member 18 is rotatably mounted on a support structure which includes a generally flat base 22 and a pair of upright spaced arms 24. A shaft 26 spans the arms 24 and is disposed in recesses formed in bosses 28 on the inside of the arms. The box-like member 18 has a pair of apertures 30 in its side walls which are larger than the diameter of the shaft 26 so that the box-like member can be freely rotated thereabout in a spinning like manner. The opposite end walls 20 of the box-like member 18 of the chance device includes indicating means for determining whether a player is to pick a card or to attempt to expose a matching playing piece. More particularly, as shown in FIG. 1, indicating means 32 in the form of the word "card" is imprinted on that end wall 20 to instruct a player to pick a card. As seen in FIG. 3, the opposite end wall has indicating means 34 in the form of the word "surprise" which indicates that a player is to lift one of the box-like devices 12 in an attempt to expose a surprise playing piece 10 matching the indicating means 16 on one of his cards 14.

To play the game apparatus of the present invention, at the start of a game, each playing piece 10 is covered by one of the box-like devices 12 and the boxes are maneuvered in a random fashion by the players over a table top or the like so as to randomly position the playing pieces thereon. Various precautions, such as the players closing their eyes, can be used to insure that the players do not know the particular position of the playing pieces. The cards 14 then are shuffled and placed with the indicating means 16 face down, in a stack as shown in FIG. 1. The order of turns for the players can be selected in any desired manner. During a player's turn, he spins the box-like member 18 until the box stops in a particular position with one of the end walls 20 being the uppermost end wall so as to face upwardly. If the end wall having the word card thereon faces upwardly, that player then can pick a card 14 from the stack thereof. Play continues until one of the players which already has acquired a card rotates the box 18 until the end wall thereof having the word surprise faces upwardly whereupon that player can lift one of the box-like devices 12 to expose the playing piece 10 therebeneath. If that player has a card 14 having indicating means 16 thereon matching the uncovered playing piece, that player can acquire the particular playing piece. The player with the most playing pieces after all have been exposed is the winner of the game. It can be seen that when a player fails to match one of his cards by uncovering a particular playing piece, all of the players must attempt to remember the position of that playing piece so that when a player's turn is reached and he has a matching card, he would simply immediately uncover that playing piece. Of course, other schemes of play are available with the game apparatus of the present invention.

The foregoing detailed description has been given for clearness of understanding only and no unnecessary limitations should be understood therefrom as some modifications will be obvious to those skilled in the art.

I claim:

1. A game apparatus, comprising:

a plurality of differently shaped playing pieces;

a plurality of devices for individually concealing or exposing each of said playing pieces;

a plurality of cards each having indicating means thereon corresponding to respective ones of said playing pieces; and a chance device for determining, during a player's turn, whether the player is to obtain a card or whether the player is to attempt to expose a playing piece corresponding to the indicating means on one of the cards that player has obtained.

2. The game apparatus of claim 1 wherein said receptacles each comprise cover means for positioning over said playing pieces so as to conceal the playing pieces from view.

3. The game apparatus of claim 2 wherein said playing pieces are three-dimensional and said receptacles comprise box-like structures positionable over the playing pieces.

4. The game apparatus of claim 1 wherein said chance device comprises a spinner device.

5. The game apparatus of claim 4 wherein said spinner device includes a generally rectangular box-like member having opposed end walls, the box-like member being mounted on a support structure for rotation about a generally horizontal axis intermediate said end walls, and including indicating means on one of said end walls instructing a player to obtain a card and the other of said end walls having indicating means instructing a player to expose one of said playing pieces.

6. The game apparatus of claim 1 wherein said playing pieces comprise small three-dimensional toys.

7. The game apparatus of claim 6 wherein said receptacles are in the form of box-like members for covering the playing pieces.

8. A game apparatus, comprising:

a plurality of differently shaped three-dimensional playing pieces;

a plurality of box-like covers for individually positioning over said playing pieces to selectively conceal or expose the playing pieces;

a plurality of cards each having indicating means thereon corresponding to respective ones of said playing pieces; and a chance device in the form of a generally rectangular box-like member having opposite end walls, the box-like member being rotatably mounted on a support structure for rotation about a horizontal axis generally intermediate said end walls, one of said end walls having indicating means thereon instructing a player during his turn to obtain one of said cards and the other end wall having indicating means thereon instructing a player during his turn to attempt to expose a playing piece corresponding to the indicating means on one of the cards that player has obtained.

9. The game apparatus of claim 8 wherein said playing pieces comprise small three-dimensional toys.

10. The game apparatus of claim 8 wherein the indicating means on each of said cards is identical to a plan representation of one of said three-dimensional playing pieces.

* * * * *